US005702105A

United States Patent [19]

Glikmann

[11] Patent Number: 5,702,105

[45] Date of Patent: Dec. 30, 1997

[54] THREE-DIMENSIONAL WORD CONSTRUCTION GAME OF SCRABBLE

[76] Inventor: Kevin L. Glikmann, 16607 Calneva Dr., Encino, Calif. 91436

[21] Appl. No.: 599,555

[22] Filed: Feb. 15, 1996

Related U.S. Application Data

[63] Continuation-in-part of Ser. No. 299,579, Sep. 1, 1994.

[51] Int. Cl.[6] ..... A63F 3/00

[52] U.S. Cl. ..... 273/272; 273/299; 273/156; 434/172; 446/122

[58] Field of Search ..... 273/272, 290, 273/299, 302, 153 R, 156, 157 R, 160; 434/171, 172, 277, 278, 281; 446/119, 122

[56] References Cited

U.S. PATENT DOCUMENTS

| | | | |
|---|---|---|---|
| 3,822,487 | 7/1974 | Koch | 446/122 |
| 3,841,001 | 10/1974 | Nicholson | 434/278 |
| 5,013,245 | 5/1991 | Benedict | 434/171 |

FOREIGN PATENT DOCUMENTS

| | | | |
|---|---|---|---|
| 0675869 | 6/1966 | Belgium | 434/278 |
| 2433122 | 1/1976 | Germany | 446/122 |
| 2456992 | 6/1976 | Germany | 446/122 |

OTHER PUBLICATIONS

"Makeit Toys", *Playthings*, Mar. 1959, p. 200, 446/122.

*Primary Examiner*—William M. Pierce
*Attorney, Agent, or Firm*—W. Edward Johansen

[57] ABSTRACT

A three-dimensional game of SCRABBLE includes a plurality of three-dimensional game pieces with letters and a plurality of connectors. Each three-dimensional game piece may be either a sphere or a cube and has at least one connector hole. Each connector connects at least one of the three-dimensional game pieces to another three-dimensional game piece along any one of three orthogonal axes. Each connector properly aligns the three-dimensional game pieces. In the three-dimensional game of SCRABBLE the letters are used to form words along either any one of three orthogonal axes or any diagonal combination of the three orthogonal axes.

3 Claims, 5 Drawing Sheets

THREE-DIMENSIONAL WORD CONSTRUCTION GAME OF SCRABBLE

This application is a continuation-in-part of an application filed on Sep. 1, 1994 under Ser. No. 08/299,579.

BACKGROUND OF THE INVENTION

The field of the invention is a three-dimensional game of SCRABBLE.

U.S. Pat. No. 2,752,158 teaches the original game of SCRABBLE which includes a game board and apluraliuty of game pieces. The game of SCRABBLE is a two-dimensional. Each game piece is flat and rectangular and has a top surface. One of the letters of the alphabet is placed on its top surface. In the two-dimensional game of SCRABBLE each player forms interlocking words in crossword fashion on a playing board by using letter tiles with various point value. Each player competes for a high score by using letters in combinations and locations that best exploit values and premium squares on the playing board.

Belgium Patent No. 675,869 teaches a three-dimensional game in which a representation of a molecule is created by three-dimensionally connecting game pieces. Each game piece has letters denoting one of the chemical elements. The geometry of the game pieces may be either spherical or cubic, The game pieces have holes and connectors.

U.S. Pat. No. 4,019,743 teaches a multi-level edifice for playing a three-dimensional word game in which the object is to gain the highest score by forming words having a fixed number of letters with the highest point value. The edifice includes a set of transparent platforms which are equal in number to the fixed number and are supported one above the other by corner posts. Each platform has a uniform array of playing sites which are equal in number to the square of the fixed number. Some sites are free and the other sites are adapted to accept playing chips which bear different letters associated with numerals representing different point values. The player forms words in a straight line on any platform level or levels on the playing edifice.

U.S. Pat. No. 4,896,889 teaches a board game which includes a playing board with a playing surface which is formed as a rectangular grid of multiple rows and columns of recesses. A multiplicity of playing pieces are dimensioned to seat within the recesses and have a body portion about the periphery of which are repetitions of an indicium, such as a letter of the alphabet, and each repetition is in a distinct color. In game play a first player may place a multiplicity of playing pieces in aligned recesses to construct a cognizable linear array of indicia much as a word. Each playing piece displays its indicium in a preselected color associated with that player. The second player may place at least one playing piece in an empty recess adjacent one of the recesses utilized by the linear array of the first player and thus create a new cognizable linear array incorporating the added indicium which is rotated to display the repetition of the indicium in a color associated with the second player. The second player also rotates the playing pieces of the first player incorporated in the new linear array to display the indicia thereof in the color associated with the second player.

U.S. Pat. No. 4,819,945 teaches a novel word game which has a generally planar game board with an intersecting grid pattern formed therein. Playing pieces for the game are formed as individual tile members with a letter of the alphabet on the upper surface thereof and projections on the bottom surface thereof for engaging the grid pattern and facilitating movement of the tile members in a horizontal or transverse direction along the grid pattern for forming words or word portions.

U.S. Pat. No. 4,776,597 teaches a game board with playing pieces in which the game board is provided with a plurality of square bosses arranged in a waffle pattern. The playing pieces are each provided with a peripheral skirt about their lower edge and an offset shoulder about their upper edge. The bosses and playing pieces are square and are of the same shape so that the playing pieces can be stacked on a respective boss of the board and on each other.

U.S. Pat. No. 4,239,231 teaches a set of dominoes which can be used for a three-dimension domino game. The indicia on the top surface of the dominoes are in the form of raised pegs, and each domino has a socket on its under surface directly below and complementary to each raised peg on the top surface. The dominoes can be used for a three-dimension game in which dominoes are placed next to each other on the same level or on top of each other where the sockets of the upper domino receive all of the pegs directly below it.

U.S. Pat. No. 4,715,605 teaches a game which includes a three-dimensional game having four cubes. There are indicia which are located at each corner of each face of each cube, as well as at a central region of each cube face. When the cubes are disposed in their proper positions and orientations with respect to each other, predetermined requirements are satisfied between various sets of the indicia indicating that an end to the game, or a solution to the puzzler has been reached. In order to serve as proofs of solutions, and thereby insure that a true solution has in fact been reached, other sets of indicia will likewise be required to satisfy predetermined relationship requirements. The indicia may include letters, numbers, colors and geometrical configurations.

SUMMARY OF INVENTION

The present invention is generally directed to a game of SCRABBLE which includes a plurality of game pieces with letters. The letters are used to form words.

In a first separate aspect of the present invention, a three-dimensional game of SCRABBLE includes a first plurality of three-dimensional game pieces and a second plurality of connectors. Each connector connects at least one of the three-dimensional game pieces to another three-dimensional game piece along either any one of three orthogonal axes or any diagonal combination of the three orthogonal axes.

In a second separate aspect of the present invention, the three-dimensional game of SCRABBLE includes a word building base and four base connectors which vary in height in order to accommodate a variety of anchoring points on the word building base.

In a third separate aspect of the present invention, the three-dimensional game of SCRABBLE includes playing piece racks which players use to hold their three-dimensional game pieces during the playing of the three-dimensional game of SCRABBLE.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
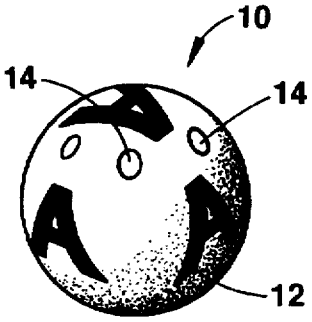
FIG. 1 is a perspective drawing of a spherical game piece a plurality of which are used in a three-dimensional game of SCRABBLE according to the first embodiment.
Figure 2:
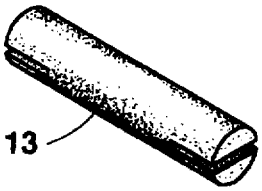
FIG. 2 is a perspective drawing of a connector a plurality of which are used to couple the three-dimensional game pieces of FIG. 1.

Referring to FIG. 1 in conjunction with FIG. 2 a three-dimensional game 10 of SCRABBLE includes a plurality of spherical game pieces 11 with letters 12 and a plurality of connectors 13. Each spherical game piece 11 has at least one connector hole 14. Each connector 13 connects at least one of the spherical game pieces 11 to another three-dimensional game piece along any one of three orthogonal axes. Each connector 13 properly aligns the spherical game pieces 11. In games other than the three-dimensional game 10 of SCRABBLE the letters 12 may be replaced with indicia from a group including numbers, colors and geometrical configurations. In the three-dimensional game 10 of SCRABBLE the letters 12 are used to form words either along any one of the three orthogonal axes or any diagonal combination of the three orthogonal axes.

Figure 3:
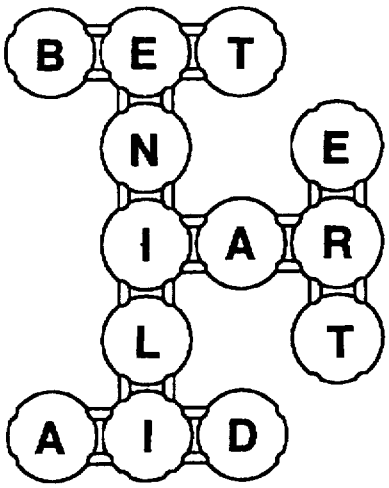
FIG. 3 is a schematic drawing of the three-dimensional game pieces of FIG. 1 which are coupled together by the connectors of FIG. 2 to form interlocking words in three-dimensional crossword fashion during the playing of the three-dimensional game of SCRABBLE.
Figure 4:
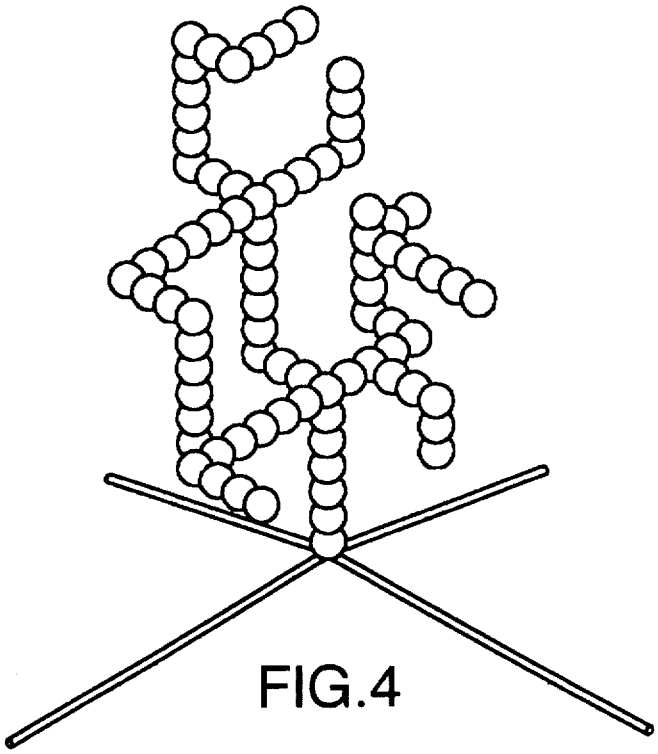
FIG. 4 is a drawing of a photograph of the three-dimensional game of SCRABBLE of FIG. 1.

Referring to FIG. 3 in conjunction with FIG. 4 in the three-dimensional game 10 of SCRABBLE a player forms interlocking words in cross-word fashion without a playing board by connecting the three-dimensional playing pieces 11 with letters and various point value in combination with one of plurality of premium connectors which are color-coded in order to provide an integral multiplier for scoring a word in the same manner as the premium squares on the playing board for a two-dimensional game of SCRABBLE. Each player competes for a high score by using letters in combinations and locations that best exploit values and the premium connectors.

Figure 5:
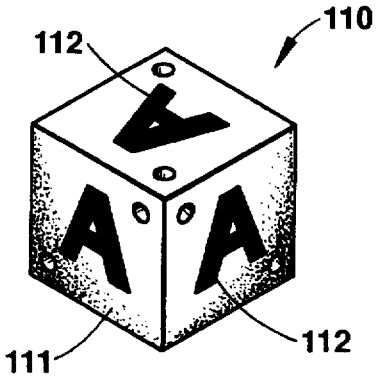
FIG. 5 is a perspective drawing of a cubic game piece for use in the three-dimensional game of SCRABBLE according to the second embodiment.

Referring to FIG. 5 in conjunction with FIG. 2 a three-dimensional game 110 of SCRABBLE includes a plurality of cubic game pieces 111 with letters 112 and a plurality of connectors 13. Each cubic game piece 111 has at least one to connector hole 114. Each connector 13 connects at least one of the cubic game pieces 111 to another three-dimensional game piece along any one of three orthogonal axes. Each connector 13 properly aligns the cubic game pieces 111. In games other than the three-dimensional game 110 of SCRABBLE the letters 112 may be replaced with indicia from a group including numbers, colors and geometrical configurations. In the three-dimensional game 110 of SCRABBLE the letters 112 are used to form words either along any one of the three orthogonal axes or any diagonal combination of the three orthogonal axes.

The three-dimensional aspect of this game of SCRABBLE provides not only an opportunity to form palindromes, like EVE, but also allows an arrangement of letters which spells two different words, STOP and POTS one with the letters in order and the other in reverse order.

Figure 6:
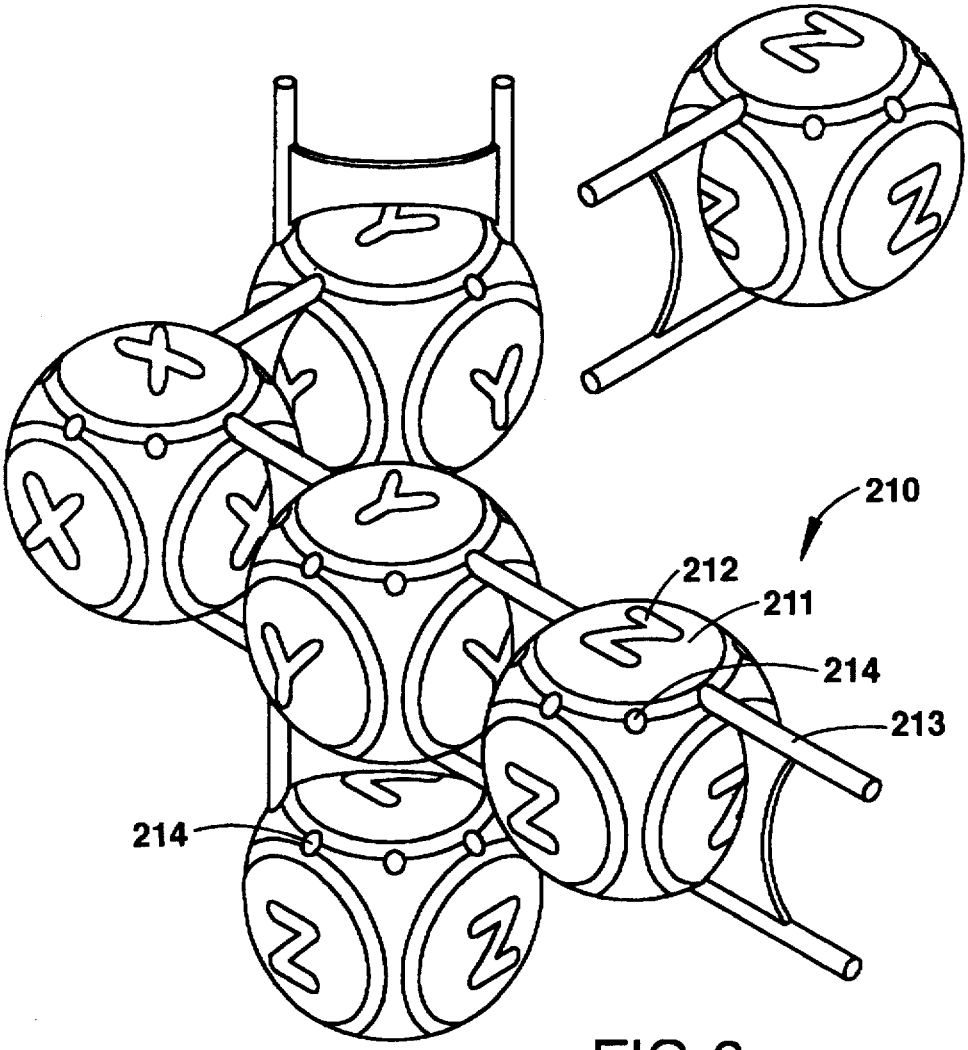
FIG. 6 is a perspective drawing of spherical game pieces and pin connectors which are used to form part of interlocking words in three-dimensional crossword fashion during the playing of the three-dimensional game of SCRABBLE according to the third embodiment.
Figure 7:
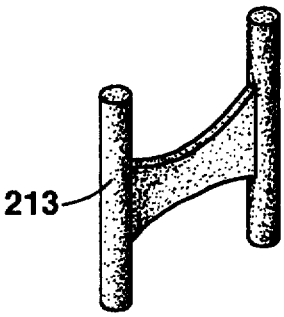
FIG. 7 is a perspective drawing of one of the pin connectors of FIG. 6.
Figure 8:
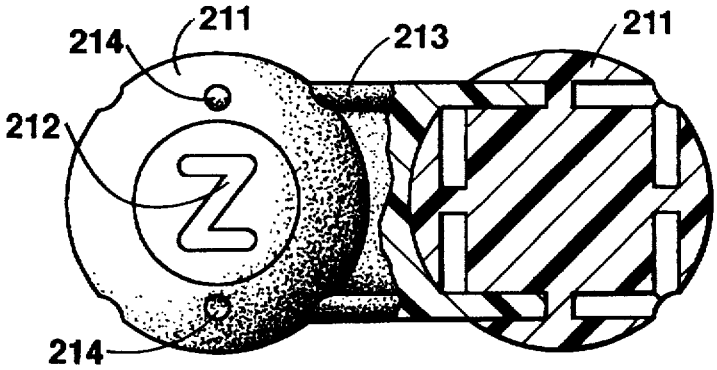
FIG. 8 is a side elevational view in partial cross-section of two spherical game pieces of FIG. 6 which are coupled together by one of the pin connectors of FIG. 6.

Referring to FIG. 6 in conjunction with FIG. 7 and FIG. 8 a three-dimensional game 210 of SCRABBLE includes spherical game pieces 211 with letters 212 and pin connectors 213 which is H-shaped. Each spherical game pieces 211 has six sets of pairs of holes 214 into which the pin connectors are inserted when the letters 212 are used to form part of interlocking words in three-dimensional crossword fashion during the playing of the three-dimensional game 210 of SCRABBLE.

Figure 9:
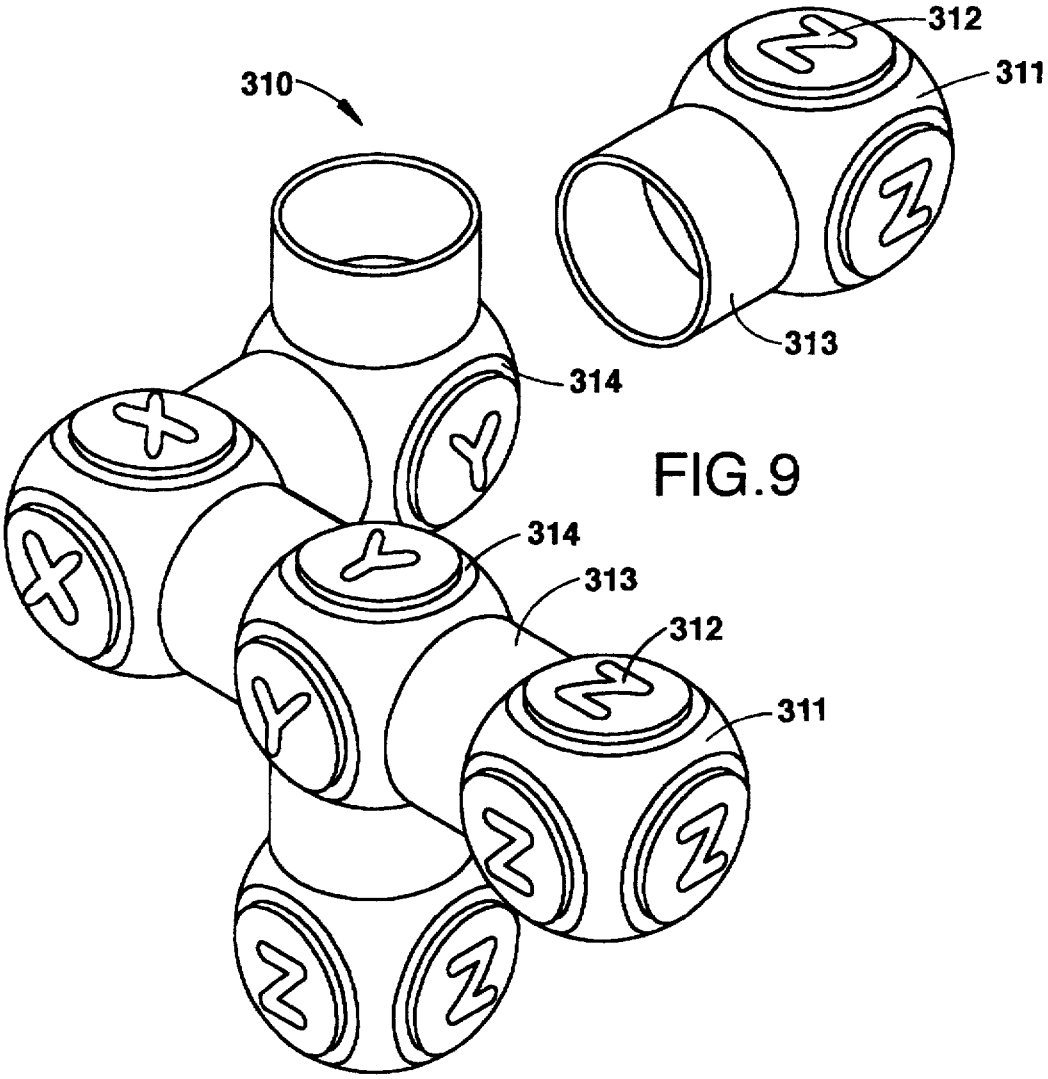
FIG. 9 is a perspective drawing of spherical game pieces and cylinder connectors which are used to form part of interlocking words in three-dimensional crossword fashion during the playing of the three-dimensional game of SCRABBLE according to the fourth embodiment.
Figure 10:
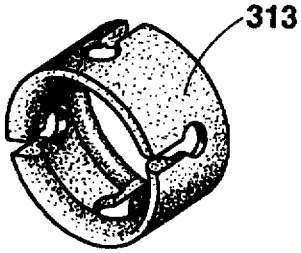
FIG. 10 is a perspective drawing of one of the cylinder connectors of FIG. 9.
Figure 11:
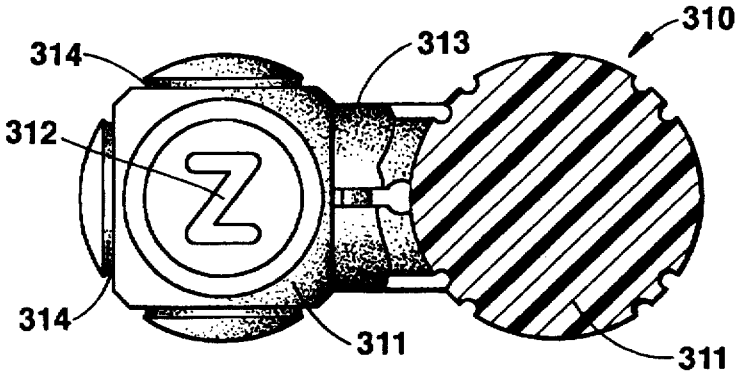
FIG. 11 is a side elevational view in partial cross-section of two spherical game pieces of FIG. 9 which are coupled together by one of the cylinder connectors of FIG. 9.

Referring to FIG. 9 in conjunction with FIG. 10 and FIG. 11 a three-dimensional game 310 of SCRABBLE includes spherical game pieces 311 with letters 312 and cylinder connectors 213. Each spherical game pieces 211 has six sets of pairs of connector grooves 314 into which the pin connectors are inserted when the letters 312 are used to form part of interlocking words in three-dimensional crossword fashion during the playing of the three-dimensional game 310 of SCRABBLE.

Figure 12:
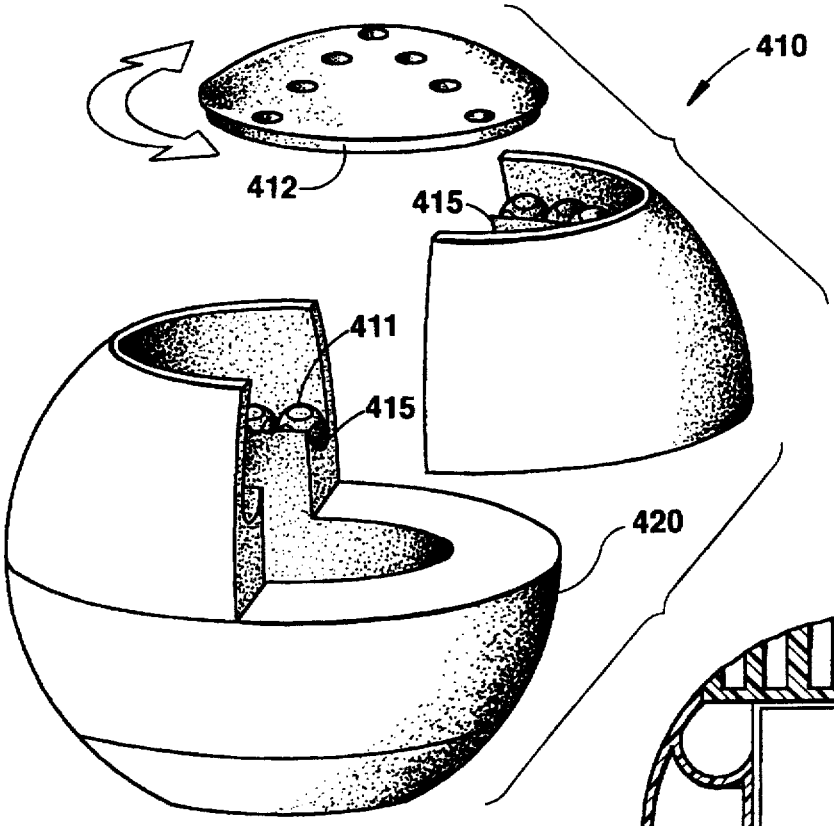
FIG. 12 is an exploded, perspective drawing of a three-dimensional game of SCRABBLE including a word building base, spherical game pieces and playing piece racks according to the fifth embodiment.
Figure 13:
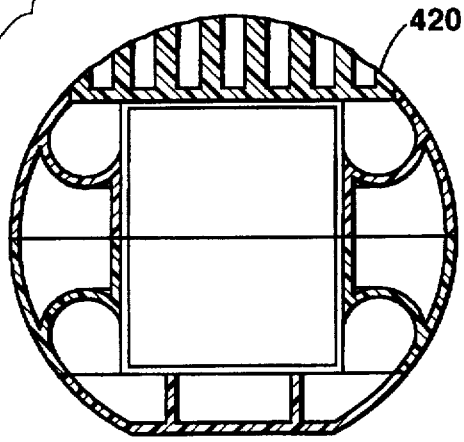
FIG. 13 is elevational view in cross-section of the three-dimensional game of SCRABBLE of FIG. 12.
Figure 14:
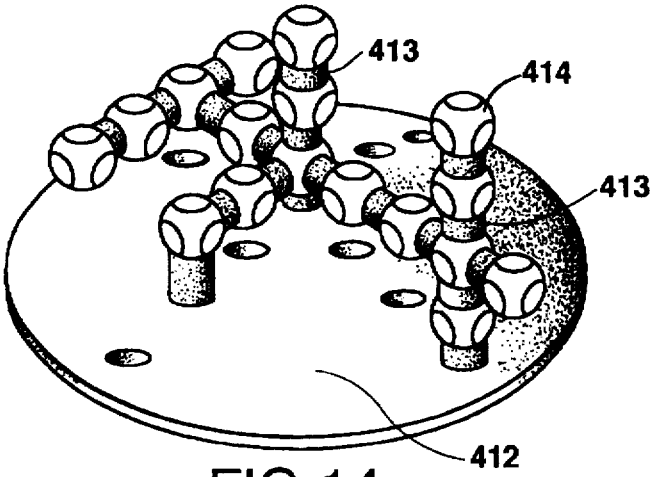
FIG. 14 is a perspective drawing of the word building base and spherical game pieces of FIG. 12, base connectors and cylinder connectors.

Referring to FIG. 12 in conjunction with FIG. 13 and FIG. 14 the three-dimensional game of SCRABBLE 410 includes spherical game pieces 411, a word building base 412, cylinder connectors 413 with letters 414 and playing piece racks 415. The word building base 412 and the playing piece racks 415 form an enclosure 420 for the three-dimensional game of SCRABBLE 410.

Figure 15:
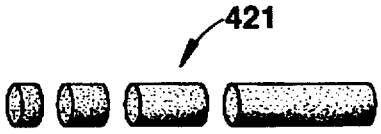
FIG. 15 is a perspective drawing of the four base connectors of FIG. 14 which vary in height in order to accommodate a variety of anchoring points on the word building base of FIG. 12.
Figure 16:
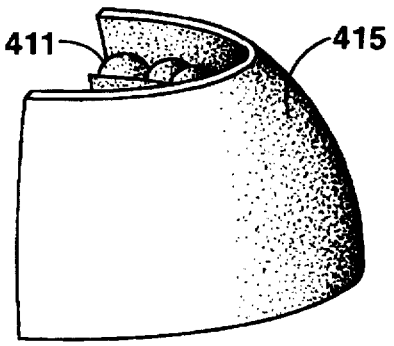
FIG. 16 is a perspective drawing of one of the playing piece racks of FIG. 12.

Referring to FIG. 14 in conjunction with FIG. 15 and FIG. 16 the three-dimensional game of SCRABBLE 410 also includes four base connectors 421. The base connectors 421 vary in height in order to accommodate a variety of anchoring points on the word building base 412. Each playing piece rack 415 holds the spherical game pieces 411 of one of the players.

Figure 17:
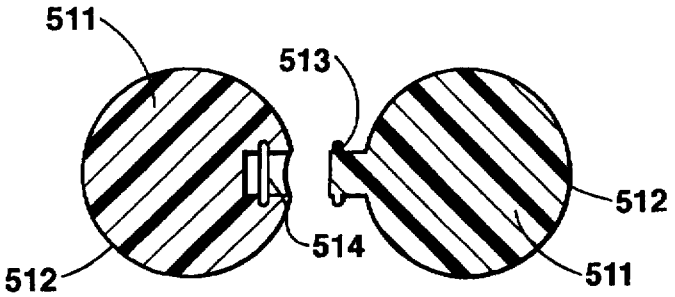
FIG. 17 is a partial side elevational view in cross-section of spherical game pieces and male-female connectors which are used to form part of interlocking words in three-dimensional crossword fashion during the playing of the three-dimensional game of SCRABBLE according to the sixth embodiment.

Referring to FIG. 17 the three-dimensional game of SCRABBLE 510 includes playing pieces 511 with a letters 512, male connectors 513 and female connectors 514. The male connectors 513 and the female connectors 514 are used to couple playing pieces 511 so that they form parts of interlocking words in three-dimensional crossword fashion during the playing of the three-dimensional game 510 of SCRABBLE.

Figure 18:
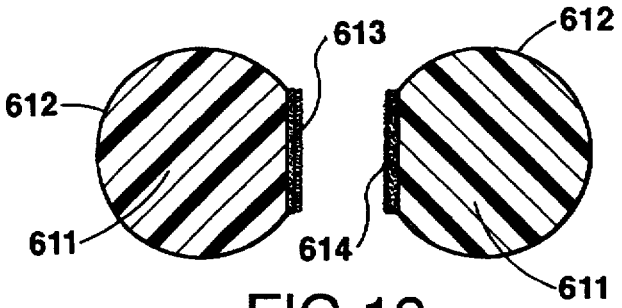
FIG. 18 is a partial side elevational view in cross-section of spherical game pieces and VELCRO connectors which are used to form part of interlocking words in three-dimensional crossword fashion during the playing of the three-dimensional game of SCRABBLE according to the seventh embodiment.

Referring to FIG. 18 the three-dimensional game of SCRABBLE 610 includes playing pieces 611 with a letters 612, male VELCRO connector pads 613 and female VELCRO connector pads 614. The male VELCRO connector pads 613 and the female VELCRO connector pads 614 are used to couple playing pieces 611 so that they form parts of interlocking words in three-dimensional crossword fashion during the playing of the three-dimensional game 610 of SCRABBLE.

Figure 19:
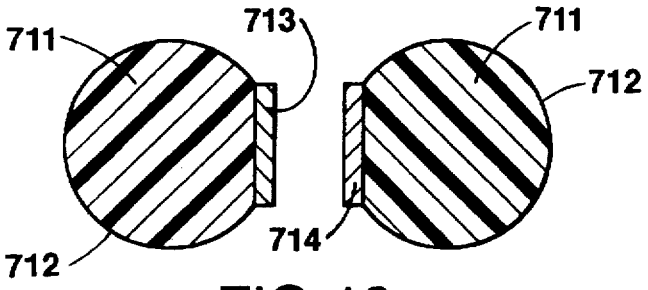
FIG. 19 is a partial side elevational view in cross-section of spherical game pieces and magnetic plate and metal plate connectors which are used to form part of interlocking words in three-dimensional crossword fashion during the playing of the three-dimensional game of SCRABBLE according to the eighth embodiment.

Referring to FIG. 19 the three-dimensional game of SCRABBLE 710 includes playing pieces 711 with a letters 712, magnetic plates 713 and metallic plates 714. The magnetic plates 713 and the metallic plates 714 are used to couple playing pieces 711 so that they form parts of interlocking words in three-dimensional crossword fashion during the playing of the three-dimensional game 710 of SCRABBLE.

From the foregoing it can be seen that a three-dimensional game of SCRABBLE has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A three-dimensional word construction game comprising:

a. a plurality of three-dimensional game pieces with a pair of indicia wherein said indicia are letters which are used in said three dimensional word construction game to form words and numbers which represent various point values for scoring each of said words;

b. a plurality of premium connectors each of which connects at least one of said three-dimensional game pieces to another of said three-dimensional game pieces along any one of three orthogonal axes and each of which represents an integral multiplier for scoring one of said words in the same manner as the premium squares on a playing board for a two-dimensional word construction game of SCRABBLE whereby each player competes for a high score by using letters in combinations and locations that best exploit said point values of said three-dimensional game pieces and said premium connectors; and c. color-coding means coupled to each of said premium connectors for color-coding said premium connector in order to indicate the value of its said integral multiplier.

2. A three-dimensional word construction game comprising:

a. a plurality of three-dimensional game pieces having a pair of indicia thereon wherein said indicia are letters and numbers;

b. a plurality of premium connectors each of which is color-coded and each of which connects at least one of said three-dimensional game pieces to another of said three-dimensional game pieces along any one of three orthogonal axes; and c. color-coding means coupled to each of said premium connectors for color-coding said premium connector in order to indicate the value of its said integral multiplier whereby in said three-dimensional word construction game said letters are used to form words along either any of said three orthogonal axes or any diagonal combination of said three orthogonal axis, said numbers provide point values which are used to score said words and each of said color-coded premium connectors provides an integral multiplier in the same manner as premium squares on a playing board for a two-dimensional word construction game of SCRABBLE.

3. A three-dimensional word construction game comprising:

a. a plurality of three-dimensional game pieces having indicia thereon wherein said indicia are letters and numbers;

b. a plurality of premium connectors each of which connects at least one of said three-dimensional game pieces to another of said three-dimensional game pieces along any one of three orthogonal axes; and c. color-coding means coupled to each of said premium connectors for color-coding said premium connector in order to indicate the value of its said integral multiplier whereby in said three-dimensional word construction game said letters are used to form words along either any of said three orthogonal axes or any diagonal combination of said three orthogonal axis, said numbers provide point values which are used to score said words and said color-coded premium connectors provide integral multipliers in the same manner as premium squares on a playing board for a two-dimensional word construction game of SCRABBLE and whereby each player competes with other players for a high score by using letters to form words in combinations and locations that best exploit said point values and said integral multipliers.

* * * * *